US007335078B2

(12) United States Patent
Kent

(10) Patent No.: US 7,335,078 B2
(45) Date of Patent: Feb. 26, 2008

(54) TACTICAL FLOTATION SUPPORT SYSTEM

(75) Inventor: David G. Kent, Virginia Beach, VA (US)

(73) Assignee: DK Solutions, Ltd,,, Virginia Beach, VA (US)

( * ) Notice: Subject to any disclaimer, the term of this patent is extended or adjusted under 35 U.S.C. 154(b) by 94 days.

(21) Appl. No.: 10/997,294

(22) Filed: Nov. 24, 2004

(65) Prior Publication Data

US 2005/0118906 A1 Jun. 2, 2005

Related U.S. Application Data

(60) Provisional application No. 60/524,061, filed on Nov. 24, 2003.

(51) Int. Cl.
*B63C 9/15* (2006.01)

(52) U.S. Cl. ..... 441/92; 441/108

(58) Field of Classification Search ..... 441/88, 441/80, 92, 108, 96; 405/185, 186
See application file for complete search history.

(56) References Cited

U.S. PATENT DOCUMENTS

| | | | | |
|---|---|---|---|---|
| 1,833,614 | A | | 11/1931 | Matuskey |
| 2,451,475 | A | | 10/1948 | Craig et al. |
| 4,360,351 | A | | 11/1982 | Travinski |
| 4,379,705 | A | | 4/1983 | Saotome |
| 4,560,356 | A | | 12/1985 | Burr |
| 4,842,562 | A | | 6/1989 | Supal |
| 5,022,879 | A | | 6/1991 | DiForte |
| 5,098,325 | A | * | 3/1992 | Kim et al. ..... 441/88 |
| 5,368,512 | A | | 11/1994 | Brown |
| 5,374,212 | A | * | 12/1994 | Lall ..... 441/96 |
| 5,382,184 | A | | 1/1995 | DiForte, Jr. |
| 5,393,254 | A | | 2/1995 | Ducheshe |
| 5,453,033 | A | | 9/1995 | Travinski |
| 5,456,623 | A | | 10/1995 | Norris |
| 5,466,179 | A | | 11/1995 | Jeffrey, Sr. |
| 5,702,279 | A | | 12/1997 | Brown |
| 5,839,932 | A | | 11/1998 | Pierce et al. |
| 5,954,556 | A | | 9/1999 | Powers |
| 6,004,178 | A | * | 12/1999 | Liu et al. ..... 441/88 |
| 6,106,348 | A | | 8/2000 | Loisel |
| 6,179,677 | B1 | | 1/2001 | Dornier |
| 6,231,411 | B1 | | 5/2001 | Vinay |
| 6,394,866 | B1 | | 5/2002 | Brown |
| 6,659,689 | B1 | | 12/2003 | Courtney et al. |
| 6,676,467 | B1 | | 1/2004 | Filsouf |
| 6,805,599 | B1 | * | 10/2004 | Huang ..... 441/88 |

* cited by examiner

*Primary Examiner*—Lars A. Olson
(74) *Attorney, Agent, or Firm*—Kimberly A. Chasteen

(57) ABSTRACT

The flotation device includes an inflatable bladder, inflation means, activation means for the inflation means and is self-contained. Preferably, a plurality of flotation bladders which are inflatable by the user, a third party or automatically are used. A closure system prevents accidental inflation of the inflation means. The devices provides buoyancy to personnel and associated equipment.

16 Claims, 3 Drawing Sheets

TACTICAL FLOTATION SUPPORT SYSTEM

CROSS REFERENCE TO RELATED APPLICATIONS

The present application claims priority from U.S. Provisional Application Ser. No. 60/524,061, filed Nov. 24, 2003.

BACKGROUND OF THE INVENTION

1. Field of the Invention

The invention is generally related to buoyancy device. More particularly, the invention is directed to a high capacity buoyancy device capable of providing buoyancy to individuals and substantial amounts of equipment.

2. Description of Related Art

Buoyancy devices are well known in the prior art, particularly in the form of waist-mounted life belts or life preservers which are typically mounted around the wearer's neck and over their shoulders. These devices are inflated manually or by $CO_2$ cartridges and provide buoyancy for an individual.

Numerous life belts exist. For example, U.S. Pat. No. 6,394,866 describes a personal flotation device which is filled using a single gas cartridge and worn in a waist belt and inflated as needed. U.S. Pat. No. 6,231,411 describes a device for providing fashionable flotation support by placing air chambers into a belt for inflation and individual buoyancy. U.S. Pat. No. 6,179,677 shows a belt for use in water activities which has a manually inflatable bladder and at least one waterproof storage pocket are built. U.S. Pat. No. 6,106,348 describes a flotation device worn around a belt having a nozzle with a geometric design which overcomes the problems introduced by using a gas cartridge and the cold gas vented from the cartridge. U.S. Pat. No. 5,954,556 describes a flotation belt with multiple bladders which can be independently inflated by gas cartridges. The bladders are integral with the belt and remain around the wearer's waist. U.S. Pat. No. 5,839,932 describes a belt mounted water rescue device having pockets to hold different water rescue aids such as an inflatable belt, rescue tow line and other rescue tools as desired. The bladder can be inflated manually or by gas cartridges. Other examples of belt-type buoyancy devices are shown in U.S. Pat. No. 5,702,279; U.S. Pat. No. 5,466,179; U.S. Pat. No. 5,456,623; U.S. Pat. No. 5,453,033; U.S. Pat. No. 5,393,254; U.S. Pat. No. 5,382,184; U.S. Pat. No. 5,368,512; U.S. Pat. No. 5,022,879; U.S. Pat. No. 4,842,562; U.S. Pat. No. 4,379,705; U.S. Pat. No. 4,360,351; U.S. Pat. No. 2,452,475; and U.S. Pat. No. 1,833,614;

U.S. Pat. No. 6,676,467 describes an airbag for swimmers. The device is intended to provide flotation for an individual and is filled by the wearer manually, an electrical pump or compressed gas. The air bag is worn around the waist or chest, under a swimsuit.

U.S. Pat. No. 6,659,689 describes a complex flotation device which provides buoyancy and rescue assistance. This device is specifically designed to support a person and a 35 lb pack. It includes an inflatable neck collar and a front positioned inflatable element. The device may also include body armor, a releasable inflatable raft, and/or a second bladder. The bladder(s) may be inflated by gas cartridges or manually.

U.S. Pat. No. 4,560,356 describes a flotation system. The system is a container which includes an inflatable flotation device. Opening the top flap of the container causes activation of a gas cartridge, inflation of the device and release of the device from the container. The container is connected to a wearer by a means such as a belt strap or the container can be connected to a boat or other water vehicle. In addition to the flotation device, the container may include water rescue devices such as an inflatable marker (also automatically inflated by opening the container flap) or other signal devices.

Therefore, there is need for a buoyancy device which is capable of providing buoyancy to individuals as well as the equipment they may need to carry, often substantial in weight. Further, there is a need for a compact, portable, lightweight, reusable device which includes redundant safety measures and which does not interfere with normal movement.

SUMMARY OF THE INVENTION

The present invention addresses these needs by providing a flotation device for a user or inanimate object. The device includes an air impermeable bladder constructed from a durable, water-resistant material such as welded nylon. The bladder is inflated by, preferably a compressed air cartridge and/or an oral inflation means. The bladder and inflation device is enclosed in a container. The container is also constructed from a water-resistant material such as nylon. The container is preferably closed by a loop, grommet and pin system. The pin is further preferably designed to actuate the compressed air cartridge such that releasing the pin simultaneously opens the container and actuates the compressed air cartridge. In the preferred embodiment, a handle releasably attached to the container actuates both the compressed air cartridge and release of the closure means. The handle can be attached to the container by hook and loop fastener, snaps or other easily released means. The container further includes an attachment device, such as a loop, for attaching the container to the user or inanimate object.

BRIEF DESCRIPTION OF THE DRAWINGS

A more complete description of the subject matter of the present invention and the advantages thereof, can be achieved by the reference to the following detailed description by which reference is made to the accompanying drawings in which.

DETAILED DESCRIPTION OF THE PREFERRED EMBODIMENT

The following detailed description is of the best presently contemplated modes of carrying out the invention. This description is not to be taken in a limiting sense, but is made merely for the purpose of illustrating general principles of embodiments of the invention.

Figure 1:
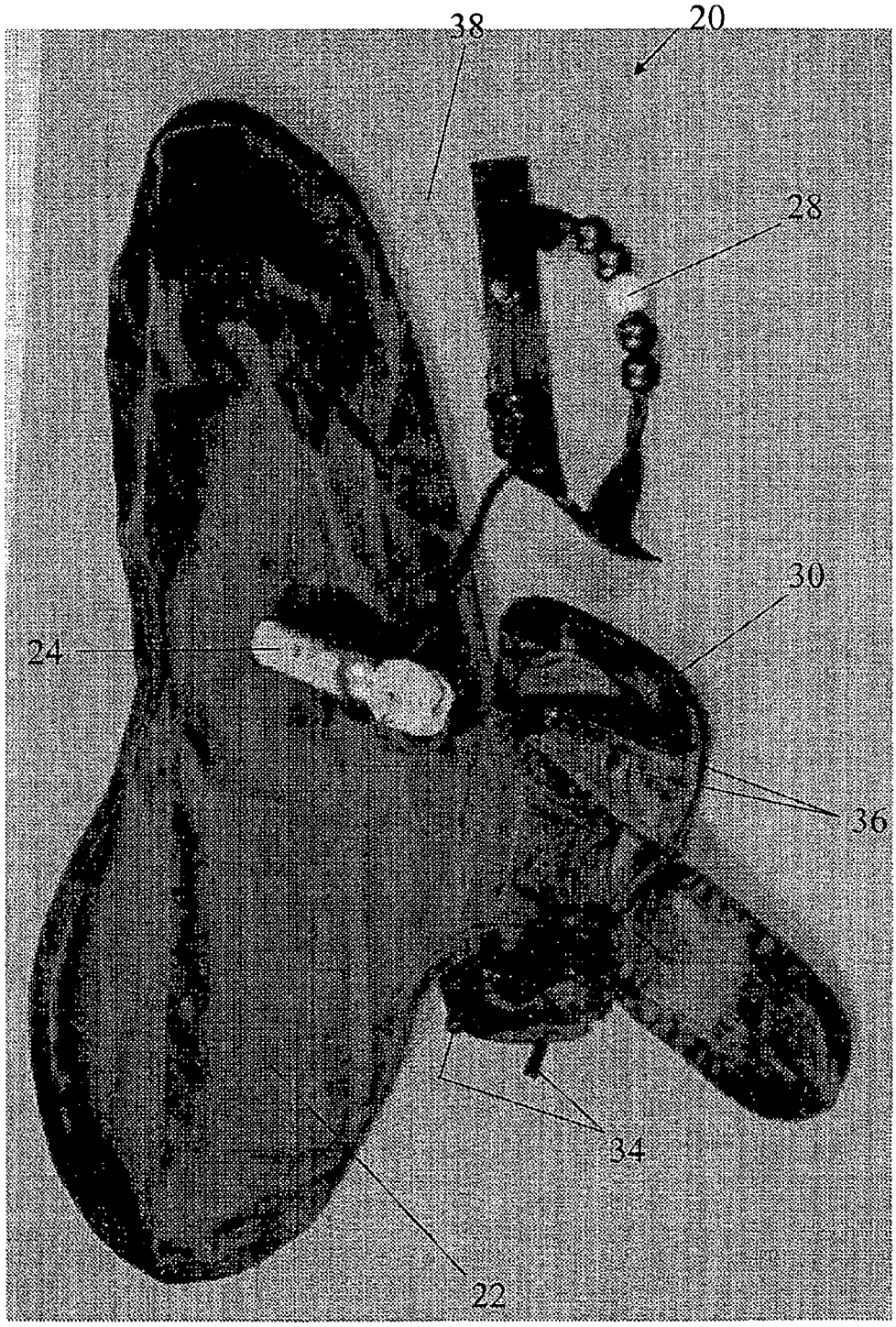
FIG. 1 is a perspective view of the present invention in the open configuration.
Figure 2A:
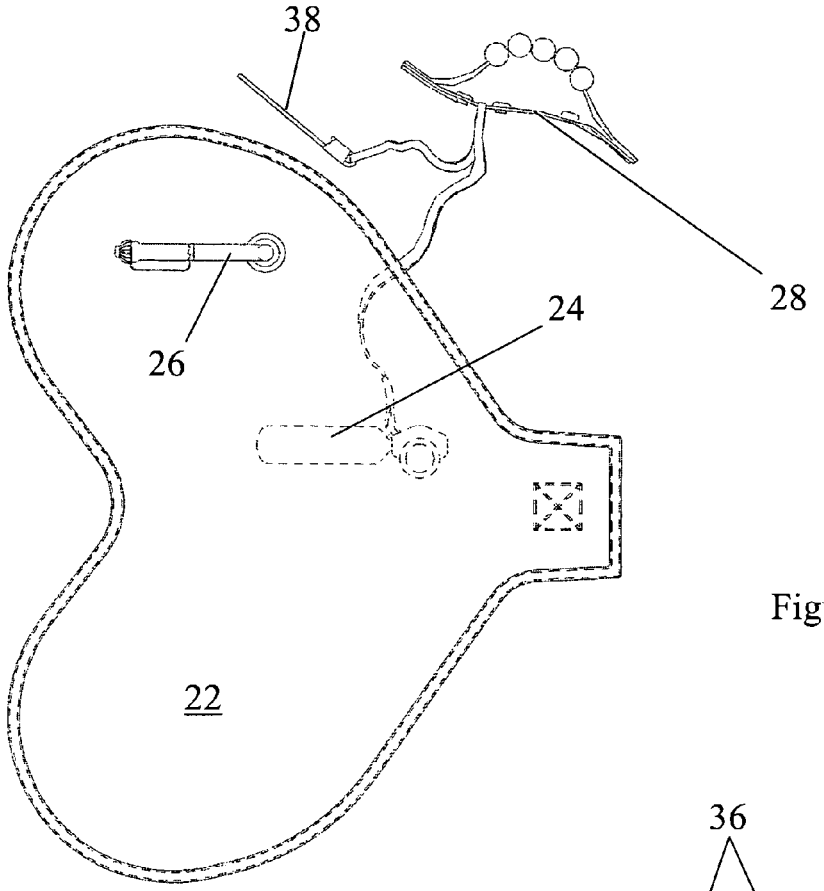
FIG. 2*a* is a front view of the bladder portion of the preferred embodiment of the present invention in the open configuration.
Figure 2B:
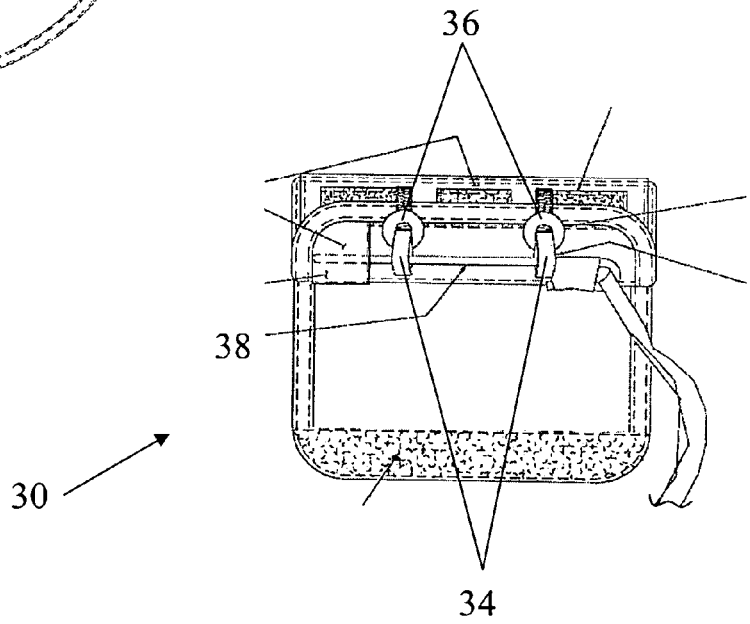
FIG. 2*b* is a front view of the container portion of the preferred embodiment of the present invention.
Figures 3A, 3B, 3C:
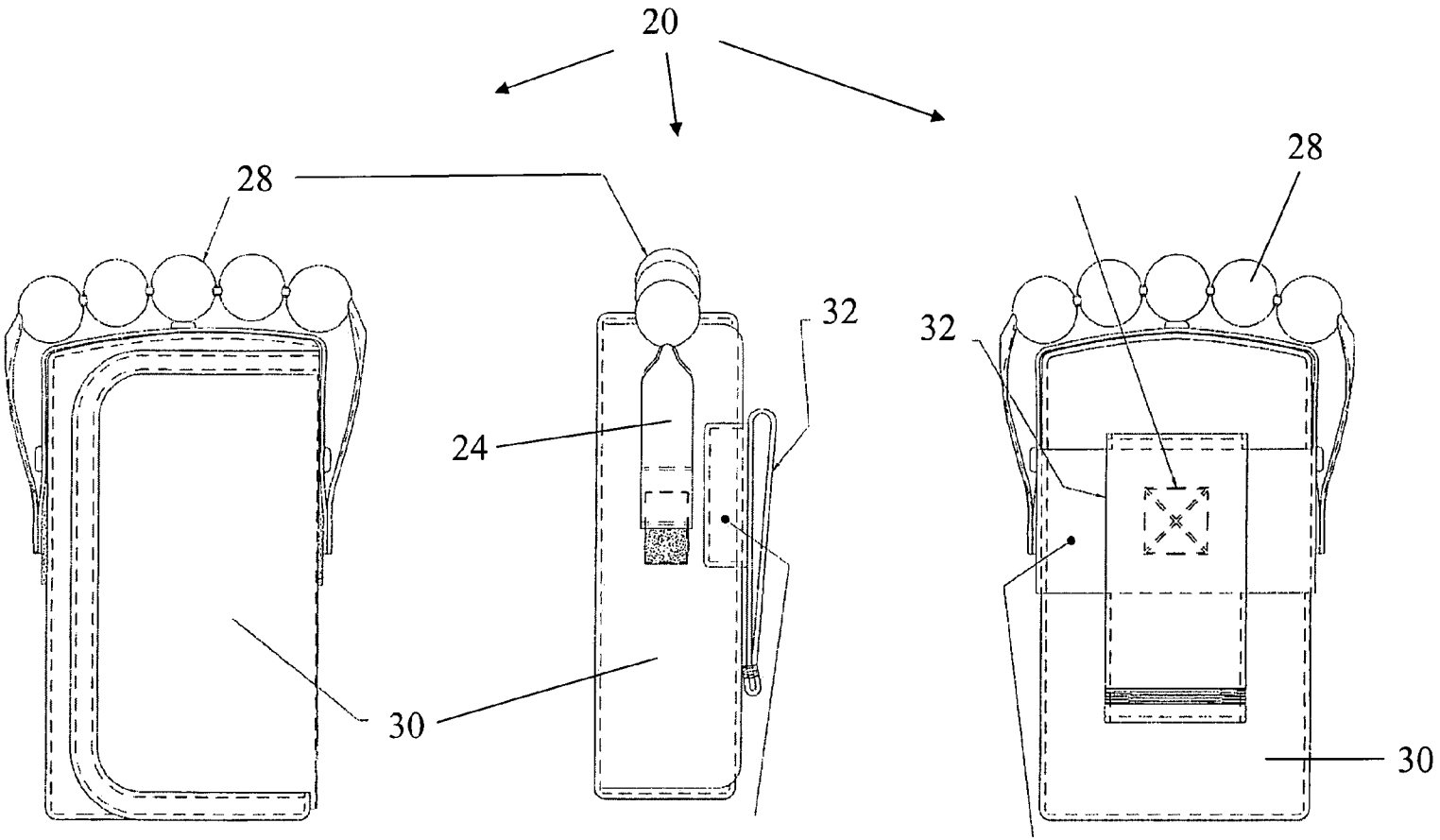
FIG. 3*a* is a front view of the preferred embodiment of the present invention in the closed configuration.
FIG. 3*b* is a side view of the preferred embodiment of the present invention in the closed configuration.
FIG. 3*c* is a rear view of the preferred embodiment of the present invention in the closed configuration.

Referring to FIGS. 1 through 3, the preferred embodiment of a flotation device 20 in accordance with the present invention is illustrated. Flotation device 20 consists of an inflatable bladder 22, at least one inflation means 24,26, activation means 28 for activating the inflation means, a container 30 and an attachment means 32 for attaching the device to a person and/or equipment.

The inflatable bladder 22 is made from a durable, air impermeable material which is preferably resistant to either fresh or salt water damage. In a particularly preferred embodiment, the bladder 22 is made from 200-denier nylon which is welded into the bladder shape.

The bladder 22 includes one or more inflation means 24,26. Preferably, one inflation means is a 38 gram $CO_2$ cartridge 24 which can be activated by the wearer or by another person. The bladder 22 can also include a manual inflation means such as an oral inflation tube 26. The inflation means 26 is preferably activated by means of a handle 28 which is releasably connected to a container 30 (described in detail below).

The bladder 22 and inflation means 24,26 are stored within a container 30. The container 30 is made from a durable, water resistant material such as nylon. The container 30 is securely attached to the bladder 22. In a particularly preferred embodiment, the container 30 is secured around the bladder 22 and inflation means 24,26 by means of loops 34 which are fed through grommets 36. A pin 38 is extended through the loops 34 as they extend through the grommets 36. In this particularly preferred embodiment, the pin 38 is connected to the handle 28 such that pulling the handle 28 to activate the $CO_2$ cartridge 24 simultaneously pulls the pin 38 to release the loops 34 from the grommets 36, thus allowing the container 30 to open such that the bladder 22 can inflate.

The handle 28 is connected to the container 30 in a manner which allows for quick and easy removal. For example, snaps or hook and loop fastener can be used.

The flotation device 20 can be attached to the wearer or equipment by any satisfactory means. In a preferred embodiment, the container 30 includes a loop 32 through which a belt or other item can be threaded. If desired, the container 30 can be structurally strengthened at the attachment point for the loop 32.

The preferred method of use by an individual is to secure two flotation devices 20, preferably one on the left and one on the right. If needed for flotation, the handle 28 is grasped and pulled to simultaneously activate the $CO_2$ cartridge 24 and open the container 30. Due to the easily accessible placement of the handle 28, the handle 28 can be activated by a person not wearing the device to provide buoyancy for a person unable to activate the device himself or for an inanimate object. In the preferred orientation, one on either side of the wearer's body, this flotation device 20 does not interfere with normal activity, whether deployed or not. In its preferred embodiment, the flotation device 20 will raise 370 lbs from a depth of 33 feet in less than 10 seconds.

The flotation device is reusable by deflating the bladder 22 and replacing it into the container 30. If necessary, the CO2 cartridge 24 is replaced. The container 30 is then reclosed using the preferred loop 34 and grommet 36 system and secured with the pin 38. The handle 28 is reattached to the container 30 resulting in a compact, easily transportable, lightweight, high capacity flotation device 20.

Many improvements, modifications, and additions will be apparent to the skilled artisan without departing from the spirit and scope of the present invention as described herein and defined in the following claims.

What is claimed is:

1. A flotation device for a user or inanimate object, comprising:
- an air impermeable bladder;
- at least one inflation means for inflating the bladder;
- a container attached to the bladder wherein the container is designed to hold the bladder and the at least one inflation means;
- a closure means for closing the container, wherein the closure means comprises:
  - at least one loop;
  - at least one grommet through which the at least one loop may extend; and
  - a retaining means for temporarily retaining the at least one loop extended through the at least one grommet;
- an actuation means for releasing the closure means; and
- an attachment means for attaching the container to the user or inanimate object.

2. The device as set forth in claim 1 wherein the bladder is constructed from a durable, water-resistant material.

3. The device as set forth in claim 1 wherein the bladder is constructed from nylon.

4. The device as set forth in claim 1 wherein the bladder is constructed from welded nylon.

5. The device as set forth in claim 1 wherein the at least one inflation means is selected from the group consisting of a compressed air cartridge and an oral inflation unit.

6. The device as set forth in claim 1 wherein the at least one inflation means is a compressed air cartridge which is actuated by the actuation means.

7. The device as set forth in claim 1 wherein the container is constructed from a durable, water-resistant material.

8. The device as set forth in claim 1 wherein the container is constructed from nylon.

9. The device as set forth in claim 1 wherein the retaining means is a pin which is actuated by the actuation means.

10. The device as set forth in claim 1 wherein the actuation means is a handle.

11. A flotation device for a user or inanimate object, comprising:
- an air impermeable bladder constructed from welded nylon;
- a compressed air cartridge for inflating the bladder;
- a container attached to the bladder wherein the container is designed to hold the bladder and the compressed air cartridge, the container further comprising:
  - a. at least one loop; and
  - b. at least one grommet through which the at least one loop may extend and be temporarily retained;
- an actuation pin for releasing the loop from the grommet and for actuating the compressed air cartridge; and
- an attachment means for attaching the container to the user or inanimate object.

12. The device as set forth in claim 11 further comprising an oral inflation unit for inflating the bladder.

13. A method for providing buoyancy to a user or inanimate object, comprising:
- providing an air impermeable bladder, which bladder includes at least one inflation means;
- securing the bladder to a container;
- placing the bladder and the at least one inflation means within the container;
- closing the container by means of a closure device, wherein the closure device comprises:
  - at least one loop;
  - at least one grommet through which the at least one loop may extend; and a retaining means for temporarily retaining the at least one loop extended through the at least one grommet;

attaching the container to the user or inanimate object; and releasing the closure device to allow inflation of the bladder.

14. The method as set forth in claim 13 wherein the at least one inflation means is selected from the group consisting of a compressed air cartridge and an oral inflation unit.

15. The method as set forth in claim 13 wherein the retaining means is a closure device pin which is actuated by the actuation means.

16. The method as set forth in claim 15 wherein the at least one inflation means is a compressed air cartridge which is actuated by releasing the closure device pin.

* * * * *